United States Patent [19]

Jessup

[11] 4,063,593

[45] Dec. 20, 1977

[54] FULL-OPENING ANNULUS PRESSURE OPERATED SAMPLER VALVE WITH REVERSE CIRCULATION VALVE

[75] Inventor: Robert L. Jessup, Marlow, Okla.

[73] Assignee: Halliburton Company, Duncan, Okla.

[21] Appl. No.: 769,123

[22] Filed: Feb. 16, 1977

[51] Int. Cl.[2] ..... E21B 43/12; E21B 47/00

[52] U.S. Cl. ..... 166/317; 166/264; 166/321

[58] Field of Search ..... 166/321, 323, 264, 319, 166/317; 175/318

[56] References Cited

U.S. PATENT DOCUMENTS

| | | | |
|---|---|---|---|
| 3,814,182 | 6/1974 | Giroux | 175/318 |
| 3,823,773 | 7/1974 | Nutter | 166/321 |
| 3,856,085 | 12/1974 | Holden et al. | 166/264 |
| 3,858,649 | 1/1975 | Wray et al. | 166/264 |
| 3,860,069 | 1/1975 | Wray et al. | 166/264 |
| 3,915,228 | 10/1975 | Giebeler | 166/321 |
| 3,930,540 | 1/1976 | Holden et al. | 166/321 |
| 3,967,647 | 7/1976 | Young | 166/321 |
| 3,970,147 | 7/1976 | Jessup et al. | 166/321 |

*Primary Examiner*—James A. Leppink
*Attorney, Agent, or Firm*—Floyd A. Gonzalez; John H. Tregoning

[57] ABSTRACT

A normally open oil well sampler valve which provides a fully open testing flow path therethrough is presented, wherein the sampler valve is closed under hydraulic control after a predetermined pressure increase in the well annulus pressure. The sampler includes two spaced apart ball valves having a sample chamber therebetween. The operating mechanism moves the ball valves from the open to the closed position simultaneously, and provides a hydraulic lock as well as a mechanical lock to prevent the balls from reopening in the well. The apparatus further includes a circulation valve which is opened after the closing of the sampler valve. One of the ball valves of the apparatus may be selectively removed to provide a single ball, safety closure valve when a well fluid sample is not desired.

17 Claims, 13 Drawing Figures

FULL-OPENING ANNULUS PRESSURE OPERATED SAMPLER VALVE WITH REVERSE CIRCULATION VALVE

BACKGROUND OF THE INVENTION

This invention relates to an apparatus for testing an oil well, and more particularly relates to a full opening closure valve which operates responsive to annulus pressure and includes a reverse circulation valve, and a full opening sampler valve including a hydraulically controlled closing mechanism.

Various tester valves and sampler valves for testing oil wells have been developed over the recent years which are responsive to changes in annulus pressure for opening and closing the valves. Reverse circulation valves responsive either to the operation of an annulus pressure responsive tester valve or responsive themselves to annulus pressure changes have also been developed. For instance, U.S. Pat. No. 3,850,250 issued Nov. 26, 1974 and U.S. Pat. No. 3,930,540 issued Jan. 6, 1975, both to Holden et al and assigned to the assignee of the present invention, disclose a circulation valve which opens after a predetermined number of annulus pressure changes have been applied to the well annulus.

U.S. Pat. No. 3,823,773 issued July 16, 1974 to Nutter discloses a circulation valve which is an integral part of a sampler mechanism wherein the sampler mechanism opens and closes responsive to pressure changes in the well annulus. The circulation valve disclosed therein moves from a closed position to an open position after a predetermined number of operations of the sampler valve. Also pertinent to the present invention is U.S. Pat. No. 3,970,147 issued July 20, 1976 to Jessup et al and assigned to the assignee of the present invention. That patent discloses a circulation valve which moves to a locked open position responsive to an increase in annulus pressure above a given value. One embodiment shows a circulation valve which is an integral part of a sliding sleeve type normally open tester valve, arranged such that the tester valve closes prior to the opening of the circulation valve.

The dual CIP reverse circulating valve offered by Halliburton Services of Duncan, Oklahoma is a reverse circulating valve in which spring loaded fingers hold a sliding sleeve mandrel in a position covering reverse circulating ports in a housing of the valve. The sleeve mandrel is spring loaded toward the open position. The dual CIP reverse circulating valve is operated by drill pipe rotation wherein rotation advances an operating mandrel which also opens and closes a tester valve mechanism. After a predetermined number of rotations the tester valve is closed and additional rotation activates a releasing mechanism which releases the fingers holding the sliding sleeve mandrel. The sliding sleeve mandrel is then moved to the open position by the mentioned spring, thereby uncovering the circulating ports to allow reverse circulation.

U.S. Pat. No. 3,856,085 issued Dec. 24, 1974 to Holden et al and assigned to the assignee of the present invention discloses an annulus pressure operated well testing apparatus which includes a full opening ball valve for providing a fully opened passageway through the testing string to the formation to be tested.

A patent application by Burchus Q. Barrington filed on the same date as the present application and assigned to the assignee of the present application discloses a full opening closure valve which is moved from the normally open position to the closed position by an increase in the pressure in the well annulus above a predetermined level, and includes a circulation valve and a full-opening sampler valve mechanism. The Barrington apparatus was developed independent of and first in time to the present invention except for the particular structure of the activating mechanism for closing the ball valves simultaneously, which is included as the preferred embodiment of both specifications, and which is included in the invention claimed herein.

The apparatus of the present invention is a normally open sampler valve which provides a fully open well testing flow path therethrough, and which is closed under hydraulic control after a predetermined pressure increase in the well annulus pressure. The sampler valve comprises two normally open ball valves connected to an operating mandrel for moving the ball valves to a closed position simultaneously. The sampler is locked, both hydraulically and mechanically, after the ball valves are moved to the closed position.

The operating mandrel is connected to a power mandrel which in turn is frangibly held in a first position until the pressure in the well annulus exceeds a predetermined level. The power mandrel is then frangibly released, and moves toward a second position under the influence of well annulus pressure.

The operating mandrel includes a thickened portion having a flow passage therethrough which, during the movement of the power mandrel from the first position to the second position, transfers a fluid from one side of the thickened portion to the other side. A metering jet in the flow passage controls the rate at which the connected power and operating mandrels move from the first position to the second position. A check valve in the flow passage prevents the operating mandrel from returning back toward the first position.

The movement of the mandrels from the first position to the second position closes the two ball valves to form a sample chamber therebetween. During its movement from the first position to the second position, the power mandrel, the operating mandrel and the ball valves move as a unit. The ball valves are rotated to the closed position by the action of pins mounted on pin arms which are retained in the walls of the sampler housing.

When the power mandrel reaches the second position, the power mandrel and the operating mandrel are disconnected by a disconnecting mechanism. The power mandrel then continues to a third position for opening a circulation valve above the sample chamber.

The disconnecting mechanism also includes a mechanical locking means to prevent the disconnected operating mandrel from moving in the opening direction. Thus, the sampler is locked in the closed position both hydraulically and mechanically.

The operating mechanism for the ball valve is further arranged for selectively disconnecting one of the ball valves for operating the apparatus as a hydraulically controlled safety closure valve.

BRIEF DESCRIPTION OF THE DRAWINGS

The apparatus of this invention is illustrated in the attached drawings which include.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. One particularly advantageous tester valve is that shown in U.S. Pat. No. 3,856,085 issued Dec. 24, 1974 to Holden et al. This valve operates responsive to pressure changes in the annulus and provides a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventers closed during the major portion of the testing procedure.

Figure 1:
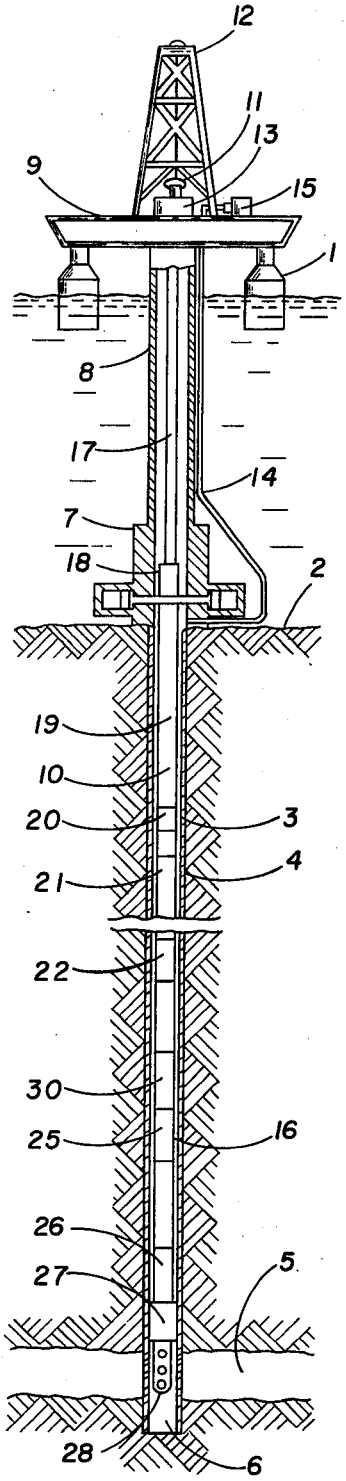
FIG. 1, a schematic elevational view of a typical well testing apparatus using the invention.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 21 which may be opened by rotation or reciprocation of the testing string or a combination of both, or by the dropping of an opening bomb in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as that disclosed in U.S. Pat. No. 3,856,085. Immediately above the tester valve is located the apparatus of the present invention 30.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become struck in the borehole 3 it is desirable to add a jar mechanism between the pressure recorder 26 and the packer assembly 27. The jar machanism in used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the preforated tail piece 28 in a suitable pressure recorder anchor shoe running case. In addition, a second pressure recorder may be run immediately above the tester valve 25 to provide further data to assist in evaluating the well.

DESCRIPTION OF THE PREFERRED EMBODIMENT

As may be seen in FIGS. *2a* through *2j*, the well apparatus 30 is comprised of a circulation valve section 160, a power section 55, and a sampler apparatus having a hydraulic impedance and locking section 75 and a dual ball valve full opening sampler section 110.

The apparatus 30 includes a tubular upper housing adapter 41 having threads 42 for connecting the apparatus into the testing string above the apparatus, an upper housing portion 43, a power piston housing 44, an intermediate housing 45, an impedance section housing 46, an upper sampler housing 47, an intermediate sampler housing 48, a lower sampler housing 49, and a lower adapter 50 which includes threads 51 for attaching the apparatus into that portion of the testing string which is below the apparatus 30. A continuous open central bore 40 is provided through all of the housing sections for communication with the flow passage through the testing string both above and below the oil well apparatus 30.

The power section 55 comprises a common power and circulation port 56 through the upper housing adapter 41 as shown. Slidably located within the apparatus housing is a power mandrel 57. A shear collar chamber 58 is provided within the upper housing adapter 41 and the upper housing 43 as shown. A shear pin collar 59 is located within the shear collar chamber 58 and is pinned to the poweer mandrel 57 by shear pins 60. The shear pins 60 are maintained in place by a concentric shear pin retainer 61 which is positioned over the shear pin collar 59 as shown.

The power mandrel 57 further includes an annular outwardly projecting power piston 62 which is subjected on one side to well annulus fluid pressure through the power and circulation port 56, the shear collar chamber 58 and a flow passage 63. The power piston 62 extends into a low pressure chamber 66 which is provided in the power piston housing 44. The low pressure chamber 66 is sealed by seals 64 between the annular piston 62 and the power piston housing 44, and by seals 65 between the power piston housing 44 and the power mandrel 57.

It can thus be seen that well annulus pressure conducted through the flow passage provided by the power and circulation port 56, the shear collar chamber 58 and flow passage 63 acting on the power piston 62 will create a downward force on the power mandrel 57 proportional to the pressure differential between the well annulus pressure and the pressure in chamber 66. When this downward force is sufficient to shear the shear pin 60 the power mandrel 57 will be free to move in a downward direction toward the lower end of the low pressure chamber 66. An elastomeric cushion ring 67 is provided in low pressure chamber 66 to cushion the impact when the power piston 62 reaches the lower end of the low pressure chamber 66.

The lower portion 70 of the power mandrel 57 includes a necked down portion 71 which is threadably attached to a C-ring retainer member 72. An expanding C-ring 73 is located in a slot between the lower end of the necked down portion 71 and the C-ring retainer 72. The expanding C-ring may be resiliently urged inwardly, but expands to the position shown in FIG. 2 when allowed to move to its normal position.

The lower portion 70 of the power mandrel 57 is connected to the hydraulic impedance and locking section 75 by a spring finger mandrel 78 which is in turn threadably connected to a push mandrel 77. The spring finger mandrel 76 includes a plurality of spring fingers 78 each of which is terminated by a head 79. As shown in FIG. 2, the power piston housing 44 includes an extension 80 which forces the spring finger head 79 inwardly into engagement with the lower portion 70 of the power mandrel 57.

The spring finger mandrel 76 is initially positioned such that there is a small lost motion space between the spring finger heads 79 and a head engaging face 81 of the power mandrel portion 70. This small lost motion space is provided to ensure that the pins 60 are completely sheared before the power mandrel 57 engages the spring finger heads 79 for pushing the spring finger mandrel 76 and the push mandrel 77 downwardly. After head engaging face 81 of the power mandrel portion 70 engages the spring finger heads 79, the spring finger mandrel 76 and the attached push mandrel 77 are pushed downwardly until the spring finger heads 79 pass the housing extension 80. After passing the housing extension 80, the spring finger heads 79 may spring outwardly into the enlarged area 82 provided by the intermediate housing 45 thereby releasing the spring fingers 78 from the power mandrel 57.

Figure 3:
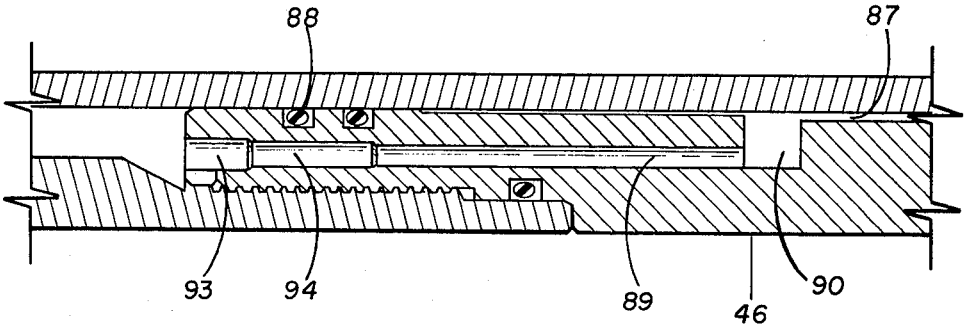
FIG. 3, a cross-sectional view of the metering system and check valve in a thickened portion of a mandrel in the sampler operating mechanism.
Figure 2J:
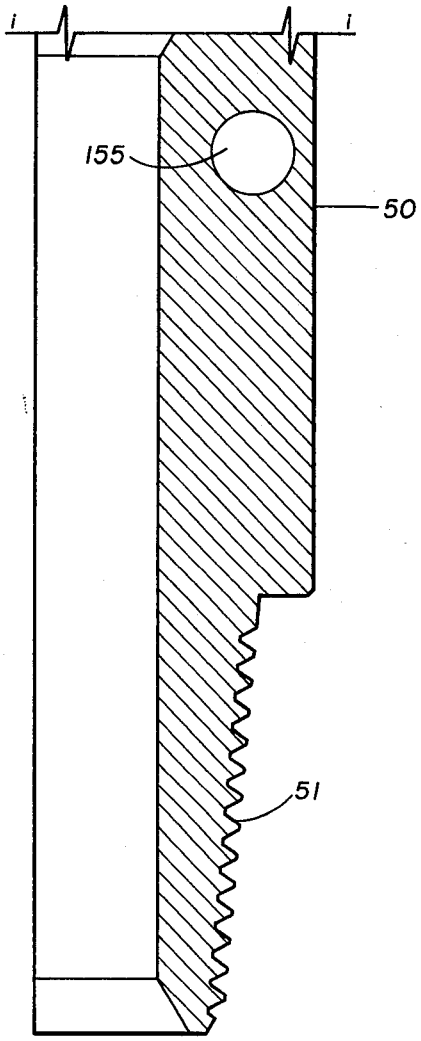

A thickened portion 83 of intermediate housing 45 co-engages with the lower portion of the spring finger mandrel 76 and is sealed by seals 84 to form the upper end of an oil filled chamber 85. The impedance section housing 46 forms the lower end of the upper oil filled chamber 85 and also forms the upper end of a lower oil filled chamber 86, thus dividing chamber 85 from chamber 86. Fluid communication between the upper oil filled chamber 85 and the lower oil filled chamber 86 is provided by impedance passageway 89, a circumferential groove 90 and an interconnected flow passage 87 as shown in FIG. 3. Seals 88 are provided between the impedance section housing 46 and the push mandrel 77 as shown to prevent fluid communication other than through the flow passageway described.

A pressure relief valve 93 and an impedance jet 94 are provided in the impedance flow passage 89, also shown in FIG. 3. The pressure relief valve 93 is designed to allow fluid flow from the upper oil filled chamber 85 to the lower oil filled chamber 86. It is further desirable to allow fluid flow only after a predetermined overpressure exists in chamber 85 over the pressure which exists in chamber 86. Such an overpressure valve is the Leepri 281, No. PRFA-2512350D sold by the Lee Company of Westbrook, Connecticut.

The impedance jet 94 serves to meter the flow rate of oil being transferred from the upper chamber 85 to the lower chamber 86 to control the rate of movement of the push mandrel 57 in the downward direction. An acceptable impedance jet is one such as the Lee Axial Visco Jet No. VXCA-2500370D made by the Lee Company of Westbrook, Connecticut.

Figure 2A:
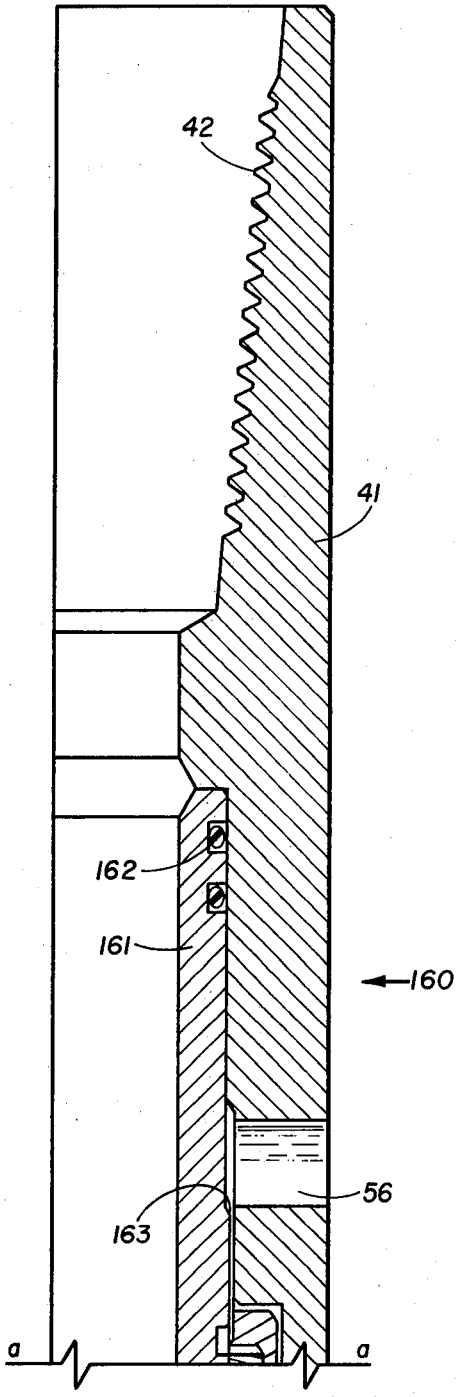
FIG. 2*a* - FIG. 2*j*, joined along section lines *a—a* through *i—i*, provide a right side only cross-sectional view of the invention with the sampler valve in the open position, and the circulation valve in the closed position.
Figure 2B:
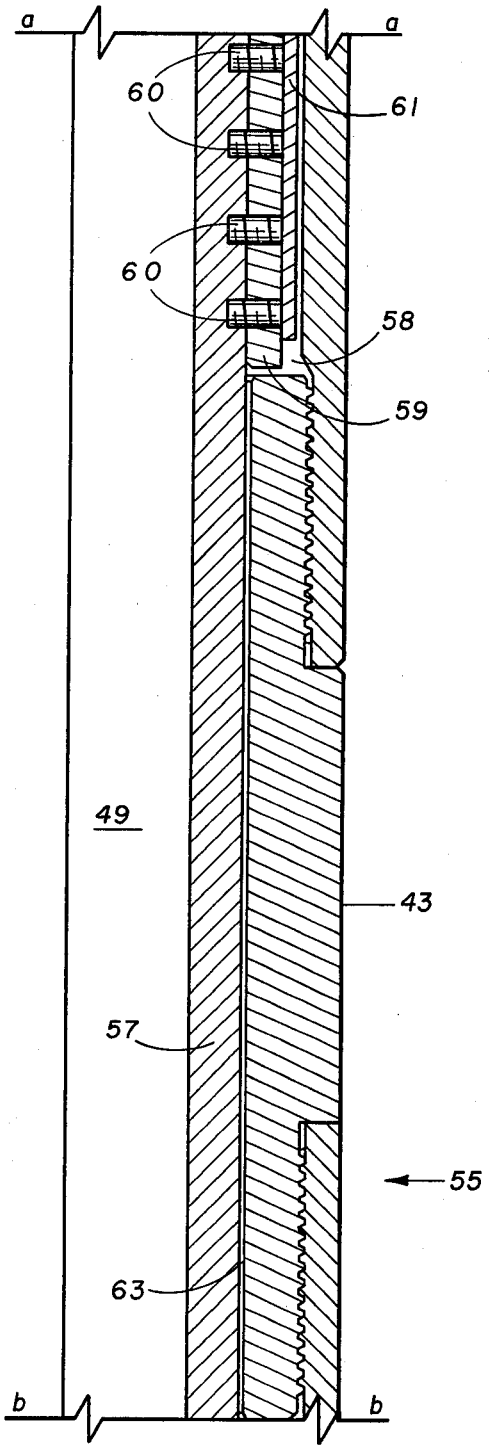
Figure 2C:
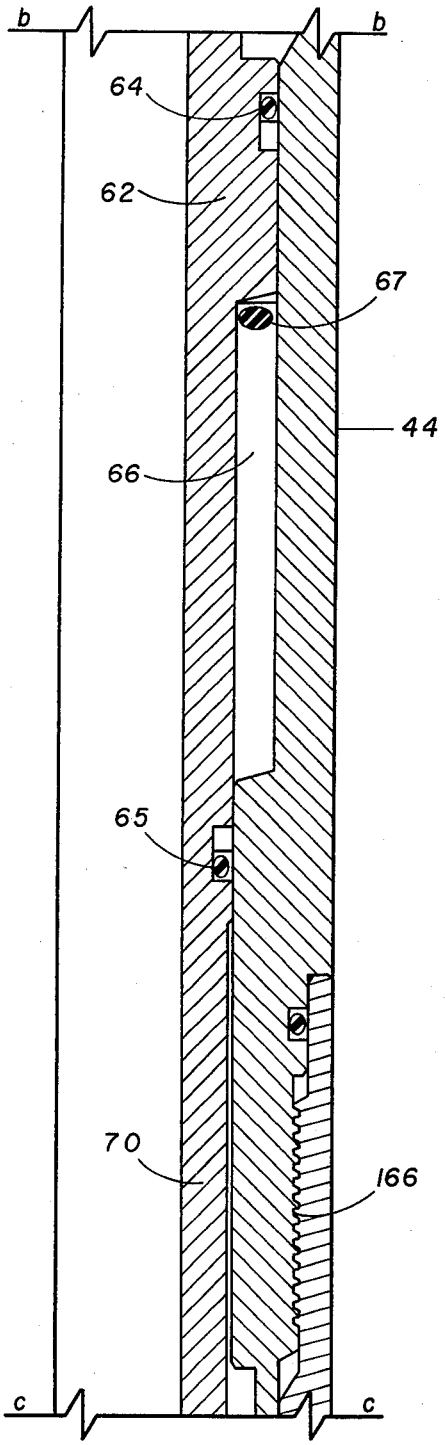
Figure 2D:
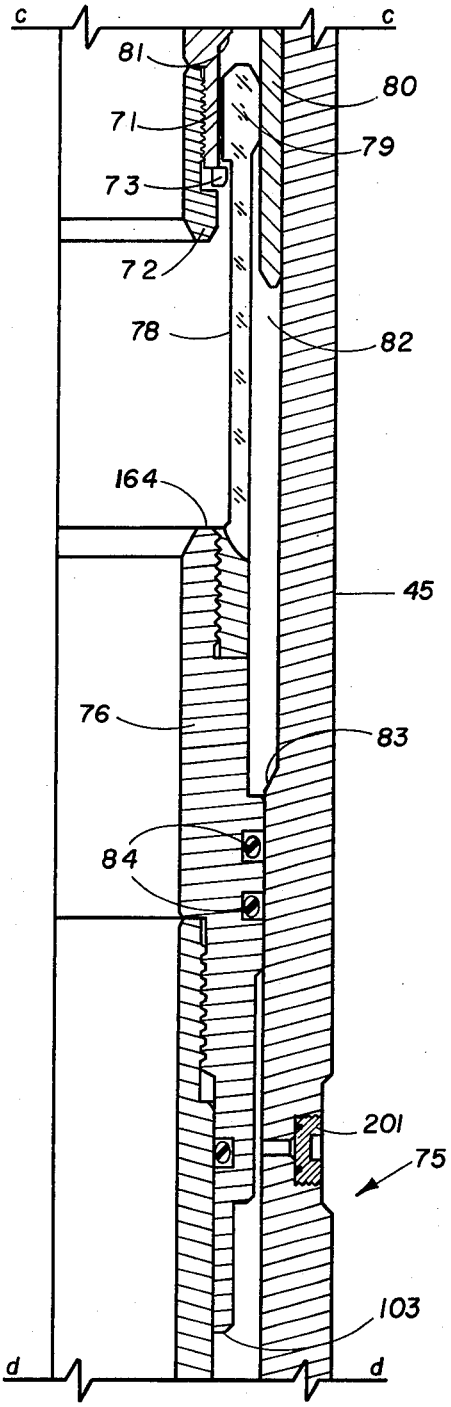
Figure 2E:
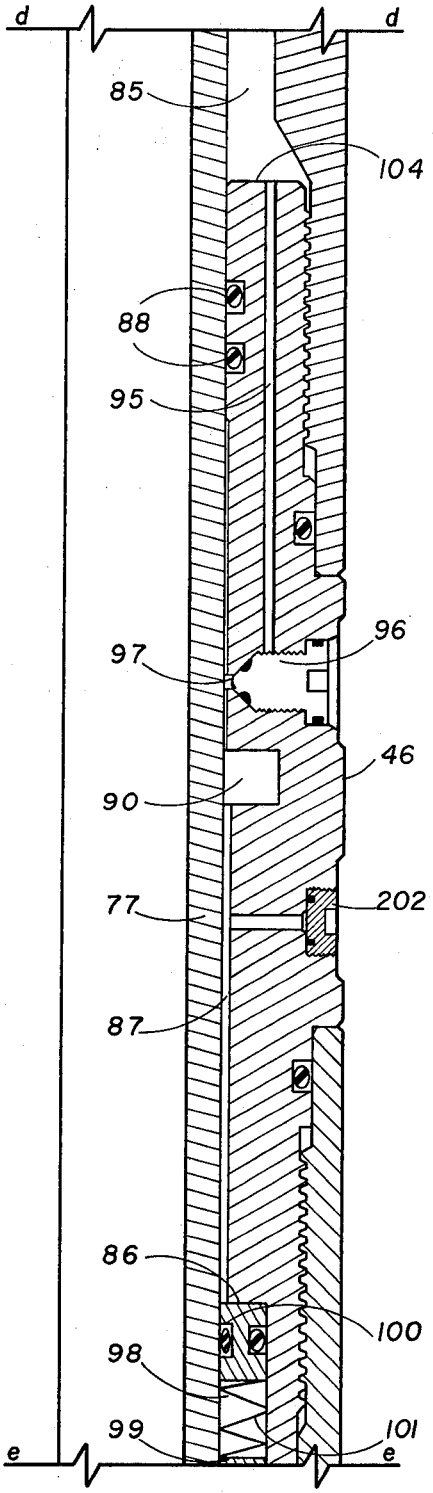
Figure 2F:
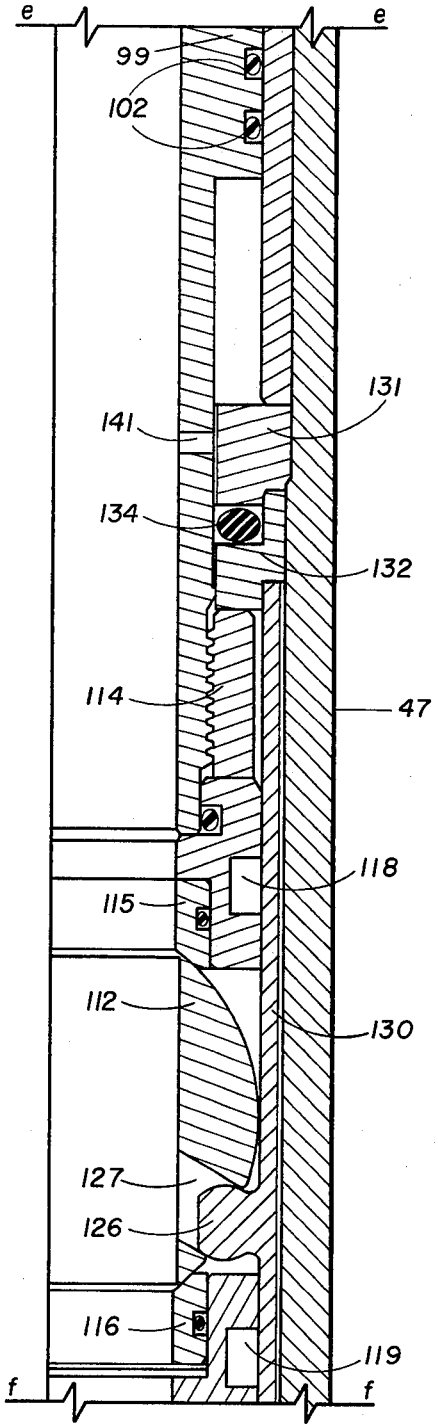
Figure 2G:
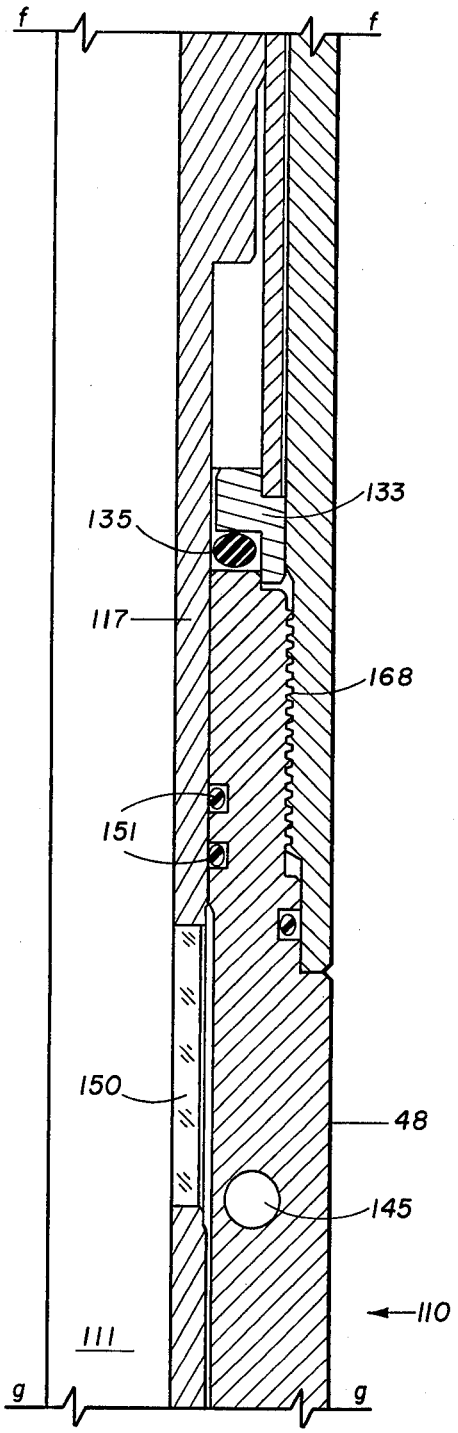
Figure 2H:
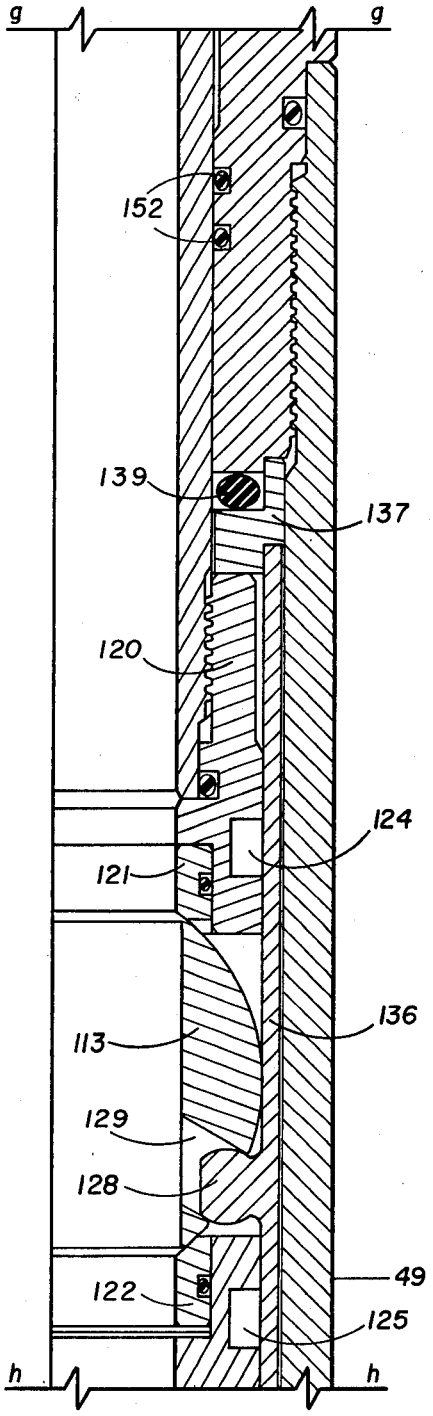
Figure 2I:
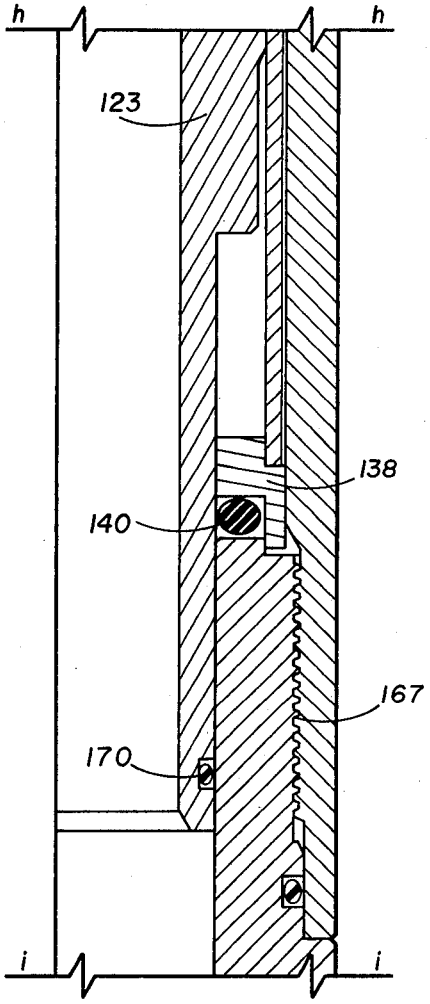

Shown in FIG. 2*e*, on the opposite side of the impedance section housing 46, revolved 180° from the impedance flow passage, is provided a bypass passage 95 which communicates with the circumferential groove 90 by an axial port 97. The bypass passage 95 and bypass port 97 are selectively blocked by a threaded bypass plug 96 in the impedance section housing 46 as shown. It will now be understood that when the push mandrel 77 has been pushed to its lowest position by the action of the power mandrel 57 that the push mandrel will be hydraulically locked into this lowermost position by the action of pressure relief valve 93. This action is brought about by the fact that hydraulic fluid in upper chamber 85 is displaced to the lower chamber 86 by the movement of the push mandrel 77. The pressure relief valve 93 then closes and will not allow fluid to be displaced from the lower chamber 86 to the upper chamber 85. The bypass passage 95 is provided to allow the pull mandrel 77 to be returned to its initial position by opening the bypass passage 95 and bypass port 97 with the bypass plug 96. This now will allow hydraulic fluid to be transferred from the lower chamber 86 through the flow passageway 87, the circumferential groove 90, the bypass port 97 and bypass passage 95 to the upper chamber 85, thereby bypassing the closed pressure relief valve 93.

A spring chamber 98 is provided in the lower end of the lower oil filled chamber 86. The lower end of the spring chamber 98 is formed by an outwardly extending annular shoulder 99 of push mandrel 77. A floating piston 100 is provided between the spring chamber 98 and the upper portion of the oil filled chamber 86. The floating piston 100 is sealed and floats against a bellevile spring 101 in the spring chamber 98 to provide an expansion chamber for the oil in chambers 85 and 86. Thus as the tool becomes heated as it is lowered into the earth, the oil in oil chamber 85 and the flow passageways and the lower oil filled chamber 86 may expand displacing the floating piston 100 against the belleville springs 101 without overstressing the various seals and cylindrical walls of the tool. The spring chamber 98 is sealed by seals 102 in the outwardly extending annular shoulder 99.

Filler means, such as threaded oil filler plugs 201 and 202, are provided through the housing walls to provide for filling chambers 85 and 86 with oil.

A downward directed face 103 on the lower end of spring finger mandrel 76 co-engages with an upward directed face 104 of the impedance section housing 46 to provide a positive stop for the push mandrel 77 after the push mandrel has traveled a predetermined distance downward under the influence of the power mandrel 57.

The push mandrel 77 operates the sample entrapping apparatus of the sampler section 110. The sample section 110 includes a sample chamber 111 between an upper ball valve 112 and a lower ball valve 113. The push mandrel 77 is threadably connected to an upper seat retainer 114 immediately above the upper ball valve 112. The upper seat retainer 114 retains an upper seat 115 in engagement with the ball valve 112. A lower seat 116 is positioned below the upper ball 112 in a connecting mandrel 117. The upper seat retainer 114 and the connecting mandrel 117 are held together by a pair of C-clamps (not shown) which extend around the ball 112 from a groove 118 in the upper seat retainer 114 to a groove 119 in the connecting mandrel 117.

The connecting mandrel 117 is threadably connected to an upper seat retainer 120 for the lower ball 113. The upper seat retainer 120 retains the upper seat 121 in engagement with the ball 113 and a lower seat 122 is retained in a lower inner mandrel 123 as shown. The upper seat retainer 120 and the lower inner mandrel 123 are held together also by a pair of C-clamps (not shown) which extend around the ball 113 from a groove 124 in the upper seat retainer 120 and a groove 125 in the lower inner mandrel 123.

It can thus be seen that when the push mandrel 77 is moved, the entire sample entrapping mechanism including the upper seat retainer 114, the upper ball valve 112, the connecting mandrel 117, upper seat retainer 120, lower ball valve 113 and lower inner mandrel 123 all move downwardly together.

During this downward movement the upper ball 112 is rotated to the closed position by the action of the upper ball operating pin 126 in a hole 127 in the upper ball 112. Likewise, the lower ball valve 113 is rotated to the closed position by the operation of lower ball operating pin 128 in a hole 129 in the lower ball 113.

Pin 126 is an inwardly directed portion of an upper pin arm 132 which is held in position in the upper sampler housing 47 by cushion retainers 131 and 132 and cushion retainer 133. A cushion ring 134 is positioned between the upper cushion retainers 131 and 132 and a cushion ring 135 is positioned between the intermediate sampler housing 48 and the lower retainer 133.

Pin 128 is an inwardly directed extension of a lower pin arm 136 which is positioned in the lower sampler housing section 49 by an upper cushion retainer 137 and a lower cushion retainer 138. A cushion ring 139 is provided between the upper cushion retainer 137 and the intermediate housing 48 and a cushion ring 140 is provided between the lower cushion retainer 138 and the lower housing adapter 50 as shown. These cushions are provided to help absorb any shock transmitted to the ball closing mechanisms to help prevent overstressing the ball operating pins 126 and 128.

The pin arms 132 and 136 are each one of a pair of pin arms, a pair for each ball 112 and 113 respectively. The pin arms are placed around the periphery of the balls alternately with the C-clamps such that the C-clamps may move relative to the pin arms in the space between the pin arms. The pin arms are also retained in the housing sections 47 and 48 respectively, such that some circumferential movement is allowed so that their associated pins may oscillate circumferentially as their respective ball valves move from the open to the closed positions, as is known in the art, and as disclosed, for example, in U.S. Pat. No. 3,856,085.

A port 141 is provided in the push mandrel 77 to prevent hydrostatic lockup due to fluids being trapped between the push mandrel 77 and the upper cushion retainer 131.

Figure 4:
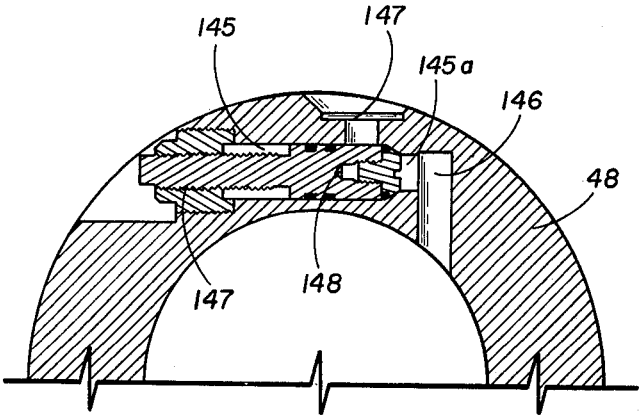
FIG. 4, a cross-sectional view of the drain valve for the sample chamber of the invention.

A drain passageway 145 is provided in the intermediate housing section 48 to allow draining the formation fluid sample trapped in the sample chamber 111 after the balls 112 and 113 have been closed. The drain valve assembly is shown in FIG. 4 and includes an inner drain port 146 which extends partially through the wall of the intermediate housing section 48. When the drain valve assembly is open, the inner drain port 146 communicates with a portion **145*a* of drain passageway 145 which in turn communicates with the outer drain port 147. A drain plug 148 is provided which may be selectively moved to open and close the outer drain port 147** and the inner drain port 146 by rotation of the drain plug in the drain passageway 145. Threads 149 are provided for advancing the drain plug 144 between the open and the closed position.

Communication between the sample chamber 111 and the inner drain port 146 is provided by slots 150 in the connecting mandrel 117. Seals 151 and 152 are provided between the intermediate housing section 48 and the connecting mandrel 117 to complete the sealing of the sample chamber 111.

As set out above, the present apparatus is most advantageous when run with an annulus pressure operated tester valve such as the one shown in U.S. Pat. No. 3,856,085. When run with such a tester valve, it is desirable to provide a means to drain well fluids trapped between the lower ball 113 and the tester valve located below the present apparatus in the testing string. Thus, a second drain port 155 is provided in the lower adapter 50 to allow the draining of formation fluids trapped between the present apparatus and the tester valve.

The apparatus includes a circulation valve section 160 which comprises a circulation valve formed by the power and circulation port 56 which is covered by the upper portion 161 of the power mandrel 57 when the circulation valve is in the closed position. Port 56 is sealed by seals 162 when the circulation valve is in the closed position to prevent communication from the well annulus exterior of the tool to the inner bore 40 of the apparatus.

The upper portion 161 of the power mandrel 57 includes a differential area 163 to provide a hydraulic pressure assist in moving the power mandrel 57 downwardly after the pins 60 shear thereby also assisting in the opening of the circulation valve.

It can thus be seen that when the well annulus pressure is increased to a predetermined level, the shear pins 60 will be sheared, thus allowing the power mandrel 57 to be moved downwardly. The force moving the power mandrel downwardly is generated by the well annulus pressure acting upon piston 62 through the flow passeway 63 provided between the power mandrel 57 and the housing 43. As discussed earlier, the differential area 163 also provides a downward force due to hydraulic pressure. As the power mandrel 57 moves down the lost motion space provided in reduced portion 71 is taken up until the heads 79 of outwardly biased spring fingers 78 engage with face 81 of the power mandrel portion 70. The power mandrel 57 now pushes the spring fingers 78 and the connected ball operating mechanism downwardly rotating the balls 112 and 113 closed by the action of pins 126 and 128 in the holes 127 and 129 of the balls respectively. The rate at which the balls are moved to the closed position is controled by the rate at which the hydraulic jet 94 allows hydraulic fluid to be transferred from the upper oil filled chamber 85 to the lower chamber 86.

When the operating mechanism is in the full downward position and the balls 112 and 113 are fully closed, the downward directed face 103 of the spring finger mandrel 76 and the upward directed face 104 of the impedance section housing 46 are engaged to prevent further downward movement of the ball operating mechanism. After the ball valves 112and 113 are fully closed they cannot be inadvertently opened because the ball operating mechanism is prevented from moving in the upward direction by the action of pressure relief check valve 93 which prevents hydraulic fluid from being transferred from the lower chamber 86 to the upper chamber 85 in the hydraulic impedance mechanism 75.

After the ball valves are closed and faces 103 and 104 are engaged, the spring finger heads 79 are moved outwardly by the outward bias of spring fingers 78 such that spring finger heads 79 move into the enlarged annular area 82 thereby disconnecting the spring finger heads 79 from the reduced portion 71 of the power mandrel 57. The positioning of the spring finger heads 79 in the enlarged area 82 also provides a mechanical lock to prevent the operating mechanism from moving in the upward, opening direction.

After the spring finger heads 79 are disconnected from the reduced portion 71 of the power mandrel 57, the power mandrel 57 can continue to move downwardly until the piston 62 reaches the lower end of the chamber 66. The cushion ring 67 cushions the impact of the power mandrel 57 when it reaches this lowermost position. This continued downward movement of the power mandrel 57 uncovers the port 56 so that communication is established between the well annulus and the interior bore 40 of the apparatus. The power mandrel portion 70 and the length of the spring fingers 78 is dimensioned such that when the power mandrel 57 is in its fully downward position, the downward directed face of the C-ring retainer 72 does not touch the upward directed face 164 of the spring finger mandrel 76. Thus,it can be seen that no additional stress is placed on the ball operating mechanism once the ball valves 112 and 113 are fully closed.

After the apparatus has been returned to the surface at the conclusion of the testing program, it is desirable to be able to disassemble the apparatus to an integral sample chamber section. This is desirable in that only the sample chamber filled with formation fluid need be transferred to a laboratory for testing. Also, by providing a separable sample chamber it is possible to transfer the fluid sample from the drillinng rig to the laboratory without the possibility of contamination of the well fluid sample.

To facilitate the disassembly of the apparatus into a separable sample section, a threaded connection 166 is provided to separate the sample section 110 from the power section 55.

Many times it is desirable to operate the apparatus as a safety closure valve rather than a sampler section. In these cases it may not be required or desirable to trap a sample of formation fluid. However, it is always desirable to have a safety valve which will close as the circulation valve is opened to ensure that the open bore of the drill string is closed in case of failure of the tester valve during the drill stem test. The present apparatus is so constructed that the bottom ball valve 113 may be removed from the apparatus. The upper ball valve 112 is then used as an emergency closure valve which operates in conjunction with the circulation valve assembly 160.

To remove the bottom ball valve 113 the apparatus is separated at threaded connection 167 and threaded connection 168. The connecting mandrel 117 is then removed and the lower inner mandrel 123 is substituted therefor below the upper ball valve 112. In this configuration a seal is provided in the groove 170 to prevent fluid communication from the lower side to the upper side of the closed ball valve 112 around the pin arm 130.

The assembly of the apparatus as a combined circulation valve and closure valve is completed by threadably engaging the lower adapter 50 with the intermediate sampler housing 48 at threaded connection 168.

It is to be understood that the foregoing disclosure and the embodiment disclosed therein is illustrative only, and that the scope of the invention intended to be protected is defined by the appended claims and the equivalents thereof.

What is claimed is:

1. An apparatus for use in testing an oil well having a testing string in a borehole providing an open flow path therethrough extending from the surface of the earth to a formation to be tested, comprising:

a cylindrical housing adapted to be incorporated in said testing string having an open bore therethrough forming a part of said open flow path, and a power port through the wall thereof;

a power mandrel in said open bore having an annular piston for moving said power mandrel in a first axial direction responsive to fluid pressure exterior of said cylindrical housing communicated to said annular piston through said power port;

frangible restraining means between said power mandrel and said cylindrical housing for holding said power mandrel in a first position until the pressure exterior of said housing exceeds a predetermined value, and for frangibly releasing said power mandrel when said pressure exterior of said housing exceeds said predetermined value allowing said power mandrel to move in said first direction toward a second position;

operating mandrel means in said open bore releasably connected to said power mandrel, and co-engaged with said cylindrical housing for forming an oil chamber between said housing and a portion of said operating mandrel means;

disconnecting means between said power mandrel and said operating mandrel means for disconnecting said operating mandrel from said power mandrel when said power mandrel reaches said second position;

dividing means between said operating mandrel means and said housing for dividing said oil chamber and including a flow passage therethrough for passing oil in said oil chamber from one side of said dividing means to the other side of said dividing means as said operating mandrel means moves in concert with said power mandrel while said power mandrel moves from said first position to said second position;

metering means in said flow passage for hydraulically controlling the rate at which oil in said oil chamber moves from one side of said dividing means to the other side of said dividing means; and sampler valve means including two ball valve means in said open bore and operatively connected to said operating mandrel means for simultaneously moving from an open position providing a fully open flow path to a closed position responsive to movement of said operating mandrel means as said power mandrel moves from said first position to said second position, and for entrapping a sample of fluid in the open bore between said ball valves upon the closing of said ball valves.

2. The apparatus of claim 1 further comprising:

stop means between said cylindrical housing and said operating mandrel means for stopping movement of said operating mandrel means in said first direction when said power mandrel reaches said second position, and for allowing said power mandrel to continue moving in said first direction to a third position after said disconnecting means has disconnected said operating mandrel means from said power mandrel; and a circulating valve mandrel arranged for axial movement in the open bore of said cylindrical housing and connected to said power mandrel for sealingly covering said power port to prevent fluid communication from the well annulus exterior of said housing and the open bore of said housing while said power mandrel moves from said first position to said second position, and for uncovering said power port to allow fluid circulation therethrough between the well annulus exterior of said housing and the open bore of said housing when said power mandrel moves to said third position.

3. The apparatus of claim 1 further comprising:

check valve means in the flow passage through said dividing means for allowing oil movement through said flow passage when said operating mandrel means moves in said first direction, and for preventing oil movement through said flow passage when said operating mandrel means attempts to move in a second, opposite direction.

4. The apparatus of claim 3 further comprising:

mechanical locking means in said disconnecting means for locking said operating mandrel means in said cylindrical housing and being operable concurrently with the disconnecting of said operating mandrel means from said power mandrel for preventing said operating mandrel means from moving in said second, opposite direction.

5. The apparatus of claim 3 further comprising:

bypass valve means in said dividing means for selectively bypassing the check valve in said flow passage through said dividing means for selectively allowing oil in said oil chamber to bypass said check valve to allow said operating mandrel means to move in said second direction.

6. The apparatus of claim 1 wherein said operating mandrel means and said sampler valve means comprises:

a push mandrel, including that portion of said operating mandrel means forming said oil chamber;

an upper ball valve seating and retaining means connected to said push mandrel for retaining the ball of one of said ball valves in said open bore, and for allowing axial movement of said one ball in concert with the axial movement of said push mandrel;

a connecting mandrel connected at one end to said upper ball valve seating and retaining means for axial movement in concert with the axial movement of said push mandrel, and for forming a sample chamber between said ball valves;

lower ball valve seating and retaining means connected to the other end of said connecting mandrel for retaining the ball of the other of said ball valves in said open bore, and for allowing axial movement of said other ball in concert with the axial movement of said push mandrel;

pin arm means positioned in the wall of said cylindrical housing adjacent the balls of said ball valves and held in position by stop means on the wall of said housing for preventing axial movement of said pin arm means and for allowing limited circumferential movement of said pin arm means;

pins on said pin arm means co-engaging the balls of said ball valves for rotating said balls between the open and closed position as said balls move simultaneously relative to said pin arms in concert with the movement of said push mandrel; and drain valve means in the wall of said cylindrical housing for draining a sample of fluid entrapped between said ball valves when said ball valves are moved from the open to the closed position.

7. The apparatus of claim 6 further comprising cushion means between said pin arm means and said pin arm means positioning stops for cushioning the impact on said pins when said ball valves are rotated between the open and closed positions.

8. The appartus of claim 7 further comprising:

threaded joint means connecting said upper ball valve seating and retaining means and said connecting mandrel for selectively removing said connecting mandrel and said lower ball valve seating and retaining means with its associated ball valve from said sampler valve and operating mandrel means; and upper and lower threaded housing joint means, one above and one below said drain valve means in said housing, for selectively removing that portion of the cylindrical housing adjacent said sample chamber from the testing string for converting said sampler valve means to a single ball, full opening closure valve as desired.

9. The apparatus of claim 1 wherein one wall of said oil chamber is movable for allowing oil in said oil chamber to expand with increased heat as the testing string is lowered into the well bore.

10. The apparatus of claim 9 wherein said one wall of said oil chamber comprises a floating annular piston between said housing and said operating mandrel means axially movable at one end of said oil chamber, and spring means between said one end of said oil chamber and said floating piston for biasing said floating piston away from said one end of said oil chamber.

11. In a full opening oil well testing sampler valve having two spaced apart ball valves in the open bore of a cylindrical housing, the operating mechanism comprising:

a power mandrel coaxially and slidably located within said open bore, and co-engaged with the walls of said housing for forming an oil chamber between said housing and a portion of said power mandrel, and for providing axial movement in said housing from a first position to a second position in a first direction;

dividing means between said power mandrel and said housing for dividing said oil chamber and including a flow passage therethrough for passing oil in said oil chamber from one side of said dividing means to the other side of said dividing means as said power mandrel moves from said first position to said second position;

metering means in said flow passage for hydraulically controlling the rate at which oil in said oil chamber moves from one side of said dividing means to the other side of said dividing means;

an upper ball valve seating and retaining means connected to said power mandrel for retaining the ball of one of said ball valves in said open bore, and for allowing axial movement of said one ball in concert with the axial movement of said power mandrel;

a connecting mandrel connected at one end to said upper ball valve seating and retaining means for axial movement in concert with the axial movement of said power mandrel, and for forming a sample chamber between said ball valves;

lower ball valve seating and retaining means connected to the other end of said connecting mandrel for retaining the ball of the other of said ball valves in said open bore, and for allowing axial movement of said other ball in concert with the axial movement of said power mandrel;

pin arm means positioned in the wall of said housing adjacent the balls of said ball valves and held in position by stop means on the wall of said housing for preventing axial movement of said pin arms and for allowing limited circumferential movement of said pin arm means;

pins on said pin arm means co-engaging the balls of said ball valves for rotating said balls between the open and closed position as said balls move simultaneously relative to said pin arms in concert with the movement of said power mandrel; and drain valve means in the wall of said housing for draining a sample of fluid entrapped between said ball valves when said ball valves are moved from the open to the closed position.

12. The apparatus of claim 11 further comprising:

check valve means in the flow passage through said dividing means for allowing oil movement through said flow passage when said power mandrel moves in said first direction, and for preventing oil movement through said flow passage when said power mandrel attempts to move in a second, opposite direction.

13. The appartus of claim 12 further comprising:

bypass valve means in said dividing means for selectively bypassing the check valve in said flow passage through said dividing means for selectively allowing oil in said oil chamber to bypass said check valve to allow said power mandrel to move in said second direction.

14. The apparatus of claim 11 further comprising cushion means between said pin arm means and said pin arm means positioning stops for cushioning the impact on said pins when said ball valves are rotated between the open and closed positions.

15. The apparatus of claim 14 further comprising:

threaded joint means connecting said upper ball valve seating and retaining means and said connecting mandrel for selectively removing said connecting mandrel and said lower ball valve seating and retaining means with its associated ball valve from said sampler valve; and upper and lower threaded housing joint means, one above and one below said drain valve means in said housing, for selectively removing that portion of the cylindrical housing adjacent said sample chamber for converting said sampler valve to a single ball, full opening closure valve as desired.

16. The apparatus of claim 11 wherein one wall of said oil chamber is movable for allowing oil in said oil chamber to expand with increased heat as the testing sampler valve is lowered into an oil well.

17. The apparatus of claim 16 wherein said one wall of said oil chamber comprises a floating annular piston between said housing and said power mandrel axially movable at one end of said oil chamber, and spring means between said one end of said oil chamber and said floating piston for biasing said floating piston away from said one end of said oil chamber.

* * * * *